US006422444B1

(12) United States Patent
Richardson

(10) Patent No.: US 6,422,444 B1
(45) Date of Patent: Jul. 23, 2002

(54) GOLF BAG WITH ANGLED RECEPTACLES

(76) Inventor: John A. Richardson, 4 Warren Pl., Armonk, NY (US) 10504

( * ) Notice: Subject to any disclaimer, the term of this patent is extended or adjusted under 35 U.S.C. 154(b) by 0 days.

(21) Appl. No.: 09/780,389

(22) Filed: Feb. 12, 2001

Related U.S. Application Data

(60) Provisional application No. 60/209,980, filed on Jun. 8, 2000.

(51) Int. Cl.[7] ..... A45F 3/04

(52) U.S. Cl. ..... 224/645; 206/315.3; 224/257; 224/259; 224/627

(58) Field of Search ..... 224/645, 257, 224/259, 627, 650, 651; 206/315.3

(56) References Cited

U.S. PATENT DOCUMENTS

| | | | | |
|---|---|---|---|---|
| 1,563,816 | A | | 12/1925 | Worthington |
| 1,680,354 | A | | 8/1928 | Williams |
| 2,010,166 | A | | 8/1935 | Thompson |
| 2,422,315 | A | | 6/1947 | Robinson |
| 2,502,627 | A | | 4/1950 | Martin |
| 2,739,631 | A | | 3/1956 | Hamley |
| 2,853,111 | A | | 9/1958 | Williams |
| 3,985,229 | A | | 10/1976 | Maki |
| 4,074,739 | A | | 2/1978 | Rodeghier |
| 4,340,227 | A | | 7/1982 | Dopkowski |
| 4,383,563 | A | | 5/1983 | Kirchoff |
| 4,420,024 | A | | 12/1983 | Clayton |
| 4,655,346 | A | | 4/1987 | Reinholz |
| D312,726 | S | * | 12/1990 | Kline ..... 224/624 |
| 5,402,923 | A | | 4/1995 | Snyder |
| 5,415,284 | A | | 5/1995 | King |
| 5,472,084 | A | * | 12/1995 | Aliano, Jr. ..... 190/108 |
| 5,816,397 | A | | 10/1998 | Pratt |
| 5,842,565 | A | | 12/1998 | Hagaman |
| 5,954,255 | A | | 9/1999 | Beebe et al. |
| 5,979,727 | A | | 11/1999 | Steurer |
| D419,294 | S | | 1/2000 | Wang |
| 6,149,041 | A | * | 11/2000 | Perino et al. ..... 206/315.3 |

FOREIGN PATENT DOCUMENTS

| | | |
|---|---|---|
| GB | 358195 | 10/1931 |
| SE | 214555 | 8/1967 |

* cited by examiner

*Primary Examiner*—Stephen K. Cronin
*Assistant Examiner*—Maerena W. Brevard
(74) *Attorney, Agent, or Firm*—Richard C. Litman

(57) ABSTRACT

A golf bag combination having separated and angled receptacles connected by a pocketed netting, a pair of integrated back pack straps, a storable large poncho-like rain cover, and integrated retractable tripod legs for standing the golf bag.

4 Claims, 2 Drawing Sheets

GOLF BAG WITH ANGLED RECEPTACLES

CROSS-REFERENCE TO RELATED APPLICATION

This application claims the benefit of U.S. Provisional Patent Application Serial No. 60/209,980, filed Jun. 8, 2000.

BACKGROUND OF THE INVENTION

1. Field of the Invention

The present invention relates generally to golf bags. More specifically, the present invention is a golf bag system having separated and angled receptacles integrated by a pocketed netting, a retractable bipod, and carried by a pair of integral back pack straps. Accessories such as a large poncho-like rain cover and towels can be stored in the pockets of the netting.

2. Description of the Related Art

The related art of interest describes various golf bags with accessories, but none discloses the present invention. There is a need for a simplified and economical golf bag system configured as separate golf club receptacles held together by a pocketed netting and including shoulder straps, retractable legs and a poncho. The related art of interest will be discussed in the order of perceived relevance to the present invention.

U.S. Pat. No. 4,655,346 issued on Apr. 7, 1987, to Orville A. Reinholz describes a self-standing golf bag comprising a cylindrical bag in three longitudinal sections of equal length that are hinged to permit the middle bag section to pivot out to form a tripod for self-standing. Each section has 4 to 5 individual club compartments. A should strap is provided on the middle bag section. The self-standing golf bag is distinguishable for its equal length, the pivoting feature and the lack of any netting.

U.S. Pat. No. 2,422,315 issued on Jun. 17, 1947, to Albert P. Robertson describes a supporting frame for twin golf bags to separate the woods from the iron clubs. The golf bags are of equal height and supported by a U-shaped rod frame of unequal height having a pivot pin on top and a cross arm with a release latch finger on the bottom. This structural configuration permits standing the two bags by spreading the bottoms thereof. A handle is positioned on the taller rod with a bent top portion to provide a swinging motion while carrying on one's shoulder. The top end secures a carrying strap to position the golf bags on the golfer's one shoulder. The carrying strap can be looped around both bags in fair-leader guides on the back bag. The supporting frame is distinguishable for its required U-shaped frame and single shoulder strap on a flexible portion of the frame.

U.S. Pat. No. 2,502,627 issued on Apr. 4, 1950, to Leslie T. Martin describes a sectional self-supporting golf bag comprising three sections hinged at the top, and having three horizontal metal loop members and a bottom cup supported by three or four upright rods to include bags. The cross-sections of the two front sections are identical and triangular. The rear section has an arcuate outer edge and two inner edges which align with the inclined edges of the front two sections to form a circular package having a strap. The legs are spread out as a tripod for standing the golf bag. The golf bag is distinguishable for its tripod structure.

Swedish Patent Application No. 214,555 published on Aug. ?, 1967, describes a compartmentalized golf bag having three compartments of different height hinged on the bottom with collapsible hinges proximate the top portions connecting and spreading the compartments. As best understood, brackets are shown on the taller two compartments to possibly cover the smaller two compartments which also have upright tabs. A carrying strap is provided on the tallest compartment. The golf bag is distinguishable for its top and bottom hinges and the lack of a connecting netting.

U.S. Pat. No. 5,415,284 issued on May 16, 1995, to Larry King describes golf club carrying case comprising two rigid housing sections hingedly connected along abutting edges each other or to a middle section, wherein all sections have notches on a top cover capable of holding clubs and recesses in their bases. A right angled bracket on top is connected to a strap handle and a flexible strap attached to one rigid housing section and looped around the sections. A folding stand is attached to the bracket. A cart and a handle can be substituted for the bracket embodiment. The carrying cases are distinguishable for having a book-type folding feature requiring a central hinge.

U.S. Pat. No. 1,563,816 issued on Dec. 1, 1925, to Charles C. Worthington describes a golf bag comprising a series of five single club containing tubes connected by two straps in a window shade manner. The top tube has a small handle and a carrying strap. The golf bag is distinguishable for lacking the netting and the angular connection of the present invention.

U.S. Pat. No. 5,482,565 issued on Dec. 1, 1998, to Smith M. Hagaman describes a box-shaped golf bag for orienting inclined golf clubs for use with a powered golf cart. The rear and middle compartments house golf balls on top, and the middle and front compartments are tiered on top with the compartment walls inclined toward the rear. The golf bag is distinguishable for its singular box-like construction.

U.S. Pat. No. 5,402,923 issued on Apr. 4, 1995, to Morris E. Snyder describes a golf bag having two identical tubular containers joined by one flexible padded shoulder strap on top and the container bottoms joined by another rigid crossbar to be held by the right hand as the bag is carried diagonally on the left shoulder. The golf bag is distinguishable for its configuration for carrying the golf bag in split portions in front and in back.

U.S. Pat. No. 4,074,739 issued on Feb. 21, 1978, to John H. Rodeghier describes a golf club and accessories carrier comprising two elongated corrugated panels bonded back to back to hold golf clubs. A top portion has a handle and compartments for golf balls and tees. The bottom portion has folding bipod legs. The carrier is distinguishable for its corrugated panel structure.

U.S. Pat. No. 3,985,229 issued on Oct. 12, 1976, to Isao Maki describes a detachably interlinked and reinforced tubular golf club protectors comprising a plurality of elongated, thin wall, lightweight tubes made of synthetic resin. The club protector tubes are distinguishable for being limited to protection during transport only.

U.S. Pat. No. 4,340,227 issued on Jul. 20, 1982, to William J. Dopkowski describes a golf club set and carrying case comprising disconnected club heads stored in a foam rubber insert of a case with one pocket for balls and tees, and one shaft stored in a pouch on one side of the case. A shoulder strap and a removable cover are provided. The golf club set is distinguishable for its integrated structure.

U.S. Pat. No. 4,420,024 issued on Dec. 13, 1983, to Charles R. Clayton describes a golf club bag comprising a plurality of elongated receptacles to hold one club each, attached together in a row and parallel to each other, adapted to be bundled and having a shoulder strap. The golf club bag is distinguishable for its parallel bundling feature.

U.S. Pat. No. 4,383,563 issued on May 17, 1983, to Christian H. Kirchhoff, Jr. describes a full service golf bag comprising a rectangular box structure having a separate tube for each club, a removable cover, a shoulder strap, a clip for the putter, and compartments for shoes, a rake/retriever, thermos, umbrella, towel, and balls. A rotatable base with rollers is provided for rolling the golf bag in airport concourses. The golf bag is distinguishable for its integrated block structure.

U.S. Pat. No. 5,816,397 issued on Oct. 6, 1998, to Michael J. Pratt describes a tiered assembly for separating the woods, irons and putter, and to hold tees and an umbrella to fit atop a conventional golf bag. An off centered highest tiered cylinder with circular grooves holds the woods. The next lower inside tier holds the putter and umbrella, and the lowest peripheral ridged tier holds the irons. The tees are apparently held in holes on a peripheral shelf. The tiered assembly is distinguishable for being limited to the top of a golf bag.

U.S. Pat. No. 2,010,166 issued on Aug. 6, 1935, to Robert E. Thompson describes a golf bag which can be inverted to expose the individual pockets for each club. A hood can also be inverted and tucked inside. The golf bag is distinguished for its parallel pocket arrangement and bag invertability.

The following three patents describe double shoulder straps for conventional golf bags holding a plurality of golf bags in one container. U.S. Pat. No. 5,979,727 issued on Nov. 9, 1999, to Steven T. Steurer describes the attachment of dual buckled shoulder straps with padding to the upper portions of a conventional golf bag. U.S. Pat. No. 2,853,111 issued on Sept. 23, 1958, to Anna K. Williams describes the addition of two buckled shoulder straps to a golf bag having tiered and slotted holders for separating and holding the various clubs. U.S. Pat. No. 5,954,255 issued on Sep. 21, 1999, to Jay N. Beebe et al. describes a dual shoulder strap arrangement by attaching both straps at the bags opening and at a mediate position of the conventional golf bag. U.S. Design Patent No. 419,294 issued on Jan. 24, 2000, to Jesse L. Wang describes a golf bag having double shoulder straps anchored together at each end to a conventional golf bag. These patents are distinguishable for being limited to shoulder straps for conventional golf bags.

U.S. Pat. No. 2,739,631 issued on Mar. 27, 1956, to Lester H. Hamley describes an open sided golf bag with dual shoulder straps and dual handles on opposite sides of the folded bag. The bag has no separation for any club. The golf bag is distinguishable for its open side and non-separation of the clubs.

U.S. Pat. No. 1,680,354 issued on Aug. 14, 1928, to Clark C. Williams describes a golf bag having a central cylindrical casing to receive golf balls and a multiplicity of vertical club-receiving pockets arranged entirely around the casing. The golf bag is distinguishable for its integrated structure.

British Patent Application No. 358,195 published Oct., 1931, describes a golf bag comprising a central pocket with an stepped opening and a number of similarly stepped separate sleeves or pockets disposed on its outside surface adapted to receive individual clubs. A shoulder strap is attached at the taller end and a bag at the bottom for golf balls. The golf bag is distinguishable for its integrated golf bag.

None of the above inventions and patents, taken either singly or in combination, is seen to describe the instant invention as claimed.

SUMMARY OF THE INVENTION

The present invention is directed to a golf bag system having separated and angled receptacles connected by a netting with pockets, an integrated pair of back pack straps, a storable large poncho-like rain cover, and integrated retractable bipod legs.

Accordingly, it is a principal object of the invention to provide a golf bag system having separated and angled receptacles for golf clubs.

It is another object of the invention to provide a golf bag system having separated and angled receptacles connected by a pocketed netting.

It is a further object of the invention to provide a golf bag system with a storable poncho-like rain cover to cover the shoulders and golf clubs.

Still another object of the invention is to provide a golf bag system with integrated bipod legs to stand up the golf bag.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a combination golf bag apparatus having a plurality of tubular golf bags combined with netting and a backstrap. A poncho-like cover and a collapsible tripod for standing the golf bag are included as accessories.

Figure 1:
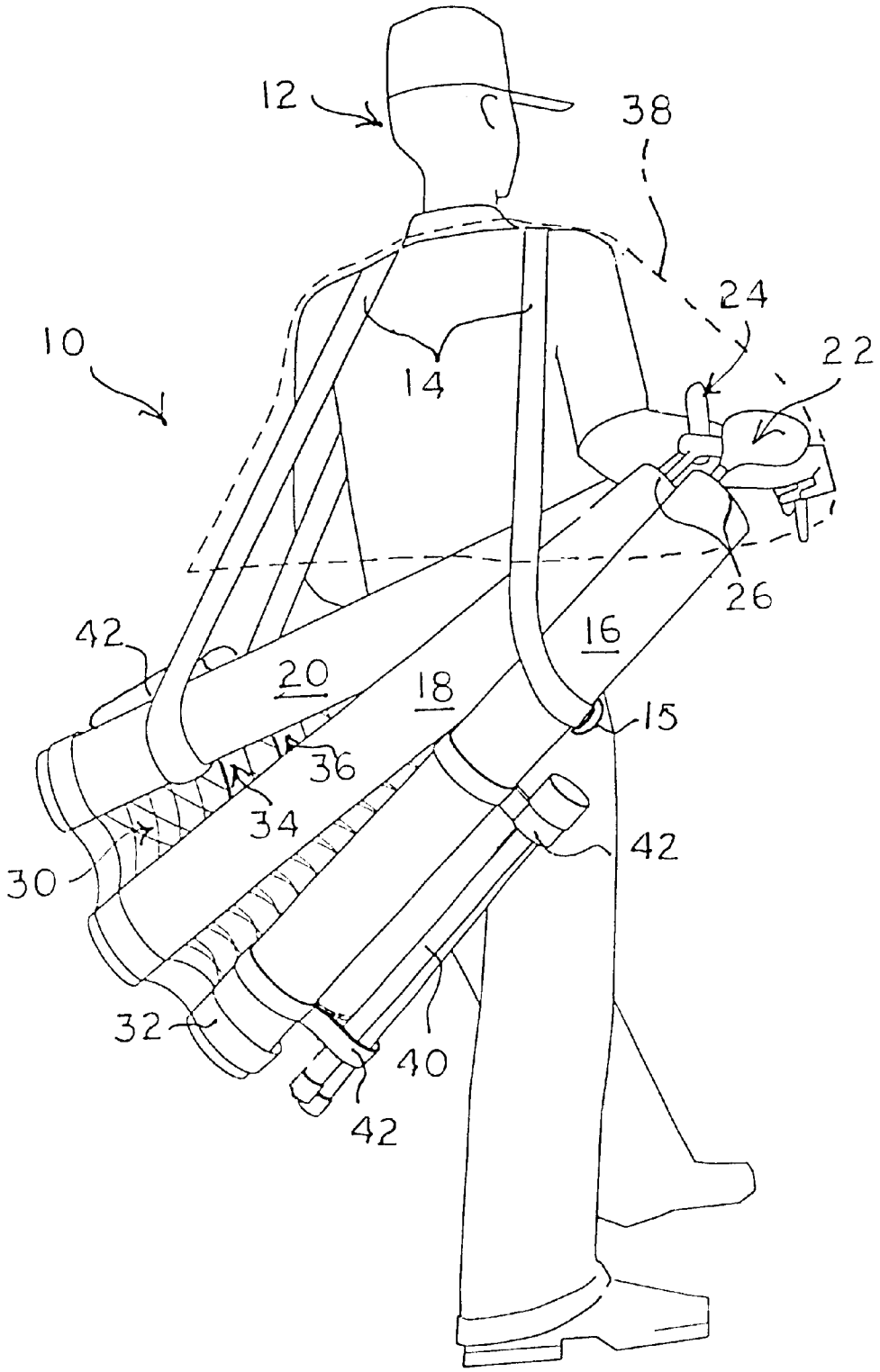
FIG. 1 is an environmental, rear perspective view of a golfer carrying a golf bag system having a back strap, three angled receptacles connected by a pocketed net, a folded bipod, and wearing a poncho according to the present invention.

In FIG. 1, the inventive golf bag apparatus 10 is shown carried by a golfer 12 by a pair of back straps 14 attached to the three club cylindrical receptacles 16, 18 and 20 of decreasing length by a hook 15 on receptacle 16. These receptacles are arranged and carried in a specific manner according to the type or length of golf clubs carried in each receptacle. The longest (drivers or "woods") clubs 22 can be carried in receptacle 16 which is inclined the most vertical to minimize the greater torque of the clubs being carried by the golfer 12. The mid-length clubs 24 such as the longer length "irons" are carried in the middle receptacle 18 having an intermediate length and inclined at approximately a 45° to the other two receptacles. The last receptacle 20 is the shortest and will contain the shortest "irons" such as the putter and wedge (not shown). Receptacle 20 can be carried at the flattest angle across the lower back, but would still maintain the clubs within the receptacle. It should be noted that only two receptacles are also contemplated, especially when a caddy carries two sets of golf bags.

Figure 2:
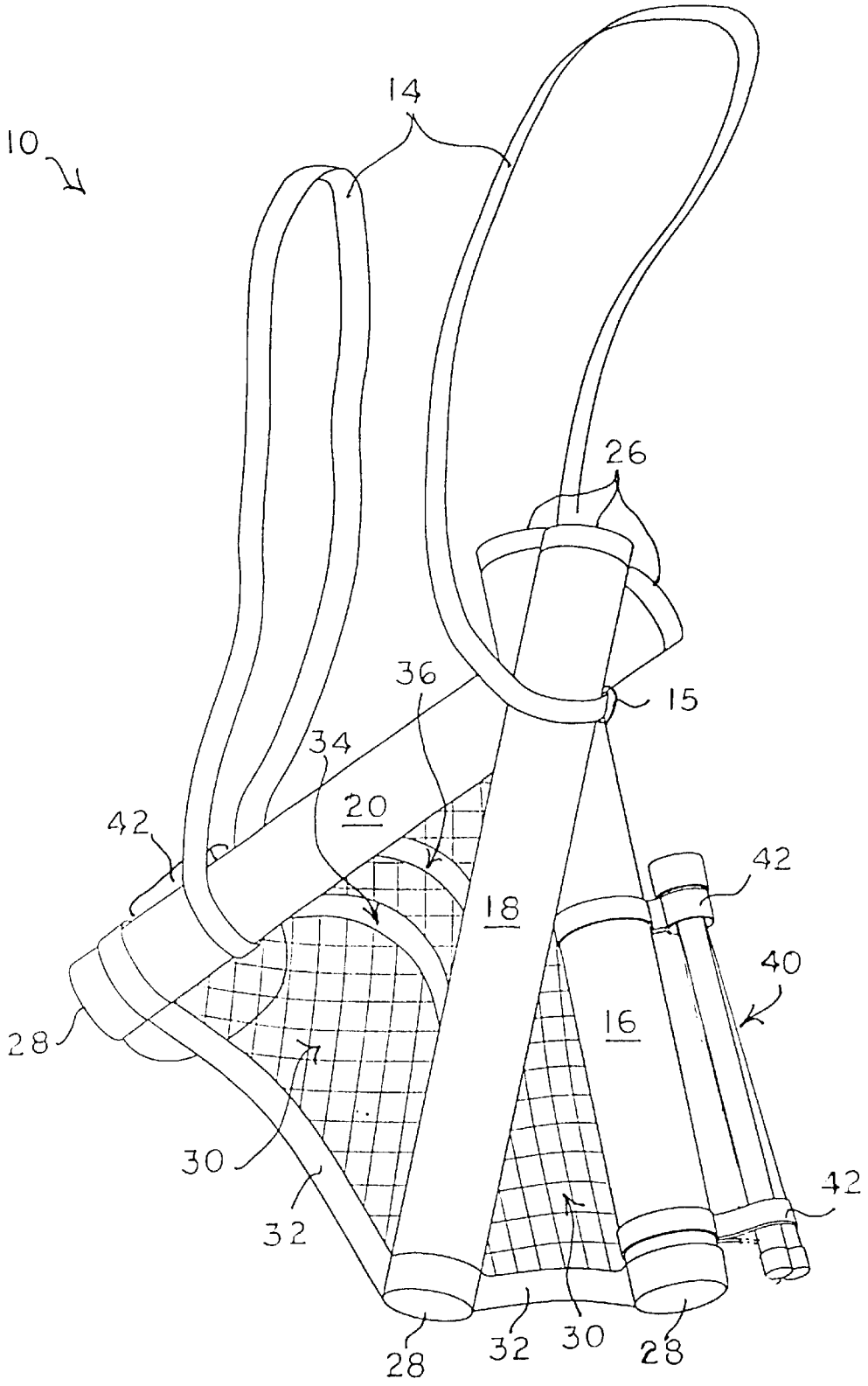
FIG. 2 is a rear elevational view of the golf bag system of FIG. 1.

The three receptacles are joined proximate the open ends 26 by one of the backstraps 14 attached to the hook 15 on receptacle 16 as depicted in FIG. 2. The other backstrap 14 is attached to the receptacle 20 proximate the closed bottom end 28. The golf bag 10 can now be carried and borne on the lumbar region of the back to minimize the weight being carried. It should be noted that an optional strap connecting the pair of backstraps 14 can be included in the vicinity of the lowest point of the straps.

The receptacles have different diameter configurations to facilitate the joining of the receptacles at their intersection. The receptacle 16 has a thin kidney-shaped opening and the receptacle 18 has a thicker kidney-shaped opening to accommodate the compaction of the receptacles at their intersection. The remainder of these receptacles have a circular diameter. The third receptacle 20 has a circular diameter throughout, but is smaller in diameter than the other two receptacles.

A netting 30 is provided to join the three receptacles 16, 18 and 20 in a predetermined pattern to help maintain the aforementioned critical relative positions of the receptacles. A reinforcement edging 32 is provided at a bottom edge of the netting 30. Pockets 34 and 36 are provided in the netting 30 for accessories such as golf balls, golf gloves and towels. A bag 42 on the bottom portion of receptacle 20 can carry a poncho-like cover 38 depicted in shadow in FIG. 1. The water repellent cover 38 is worn over the shoulders and is long enough to cover the clubs 22, 24 in the receptacles A conventional retractable bipod 40 is attached to one of the receptacles such as receptacle 16 by holders 42 for use in standing the golf bag 10.

It should be noted that the pair of back straps 14 can also be carried over one shoulder of the golfer 12 to accommodate the carrying of a second bag on the other shoulder by a caddy. The accessories located in the pockets 34, 36 in the netting 30 can readily be accessed by the caddy's left hand while the clubs are accessed by the right hand without difficulty.

It is to be understood that the present invention is not limited to the sole embodiments described above, but encompasses any and all embodiments within the scope of the following claims.

I claim:

1. A golf bag combination comprising:

a plurality of separate golf club receptacles, each receptacle having a cylindrical shape, an upper open end and a closed bottom end;

a strap attaching the bottom ends of each of the plurality of the golf club receptacles;

a webbed netting element connecting each of the plurality of golf club receptacles to each other and extending from the strap to proximate the upper open ends; and a pair of shoulder straps, wherein one strap is attached to proximate the bottom end of one of the plurality of receptacles and the other strap is attached to the plurality of receptacles proximate the upper open ends thereof.

2. The golf bag combination according to claim 1, including a retractable bipod stand attached to one of the receptacles.

3. The golf bag combination according to claim 1, including a separate poncho rain cover for covering the clubs and shoulders of a golfer carrying the golf bag.

4. The golf bag combination according to claim 1, including at least one small bag for carrying the poncho rain cover and articles attached to one of the plurality of receptacles proximate the bottom end thereof.

* * * * *